US007343712B2

(12) United States Patent
Shelton

(10) Patent No.: US 7,343,712 B2
(45) Date of Patent: Mar. 18, 2008

(54) WOODEN MEMBER SUPPORT RETROFIT SYSTEM AND METHOD

(76) Inventor: David R. Shelton, P.O. Box 6356, Tahoe City, CA (US) 96145

( * ) Notice: Subject to any disclaimer, the term of this patent is extended or adjusted under 35 U.S.C. 154(b) by 527 days.

(21) Appl. No.: 10/671,898

(22) Filed: Sep. 25, 2003

(65) Prior Publication Data

US 2005/0069380 A1 Mar. 31, 2005

(51) Int. Cl.
*E04B 1/36* (2006.01)
*E04B 1/38* (2006.01)

(52) U.S. Cl. ..... 52/126.1; 52/289; 52/291; 52/702; 52/573.1; 52/741.1

(58) Field of Classification Search ..... 52/289, 52/291, 702, 126.1, 514, 573.1, 741.1, 712, 52/480; 403/189, 232.1; 248/188.2, 188.3
See application file for complete search history.

(56) References Cited

U.S. PATENT DOCUMENTS

| | | | | | |
|---|---|---|---|---|---|
| 770,050 | A | * | 9/1904 | Dreyer | 403/190 |
| 1,045,984 | A | * | 12/1912 | King | 254/104 |
| 1,977,496 | A | * | 10/1934 | Snyder et al. | 52/393 |
| 2,032,344 | A | * | 3/1936 | Barrows et al. | 52/204.599 |
| 2,076,388 | A | * | 4/1937 | Venzie | 52/393 |
| 2,431,342 | A | * | 11/1947 | Hathaway et al. | 493/462 |
| 2,813,311 | A | * | 11/1957 | Vaughn | 52/204.5 |
| 2,919,476 | A | * | 1/1960 | Fritz | 52/393 |
| 3,030,730 | A | * | 4/1962 | Costar | 248/188.2 |
| 3,699,734 | A | * | 10/1972 | Craig et al. | 52/127.6 |
| 3,778,954 | A | * | 12/1973 | Meserole | 52/747.1 |
| 4,124,962 | A | | 11/1978 | Lancelot, III et al. | |
| 4,158,940 | A | | 6/1979 | Lancelot, III et al. | |
| 4,192,623 | A | | 3/1980 | Borg | |
| 4,223,866 | A | | 9/1980 | Black | |
| 4,485,607 | A | * | 12/1984 | Nelson | 52/741.1 |
| 4,513,939 | A | * | 4/1985 | Berger et al. | 248/544 |
| 4,713,922 | A | * | 12/1987 | Ingold | 52/656.2 |
| 4,798,359 | A | * | 1/1989 | Ball | 248/188.3 |
| 4,830,320 | A | * | 5/1989 | Bellows | 248/188.2 |
| 4,856,250 | A | * | 8/1989 | Gronau et al. | 52/480 |
| 4,858,865 | A | * | 8/1989 | Schrepfer | 248/188.2 |
| 4,920,725 | A | * | 5/1990 | Gore | 52/702 |
| 5,180,268 | A | * | 1/1993 | Richardson | 411/536 |

(Continued)

FOREIGN PATENT DOCUMENTS

FR 2589919 * 5/1987

(Continued)

*Primary Examiner*—Robert Canfield
(74) *Attorney, Agent, or Firm*—Kelly Lowry & Kelley LLP

(57) ABSTRACT

A wooden member support retrofit system includes a wooden member support having a support base and a wooden member supported by the wooden member. The system also includes a shim disposed in a space formed between the base and the wooden member due to relative movement of the base and the wooden member over time. A process of retrofitting a wooden member support system includes measuring a space formed between a base of a wooden member support and a wooden member due to relative movement of the base and the wooden member over time. The system includes selecting a shim and placing the shim in the space formed between the base and the wooden member.

12 Claims, 4 Drawing Sheets

U.S. PATENT DOCUMENTS

| | | | | | |
|---|---|---|---|---|---|
| 5,249,767 | A | * | 10/1993 | Mellen | 248/188.2 |
| 5,465,548 | A | * | 11/1995 | Niese | 52/741.1 |
| 5,492,292 | A | * | 2/1996 | Richards | 248/188.2 |
| 5,540,530 | A | * | 7/1996 | Fazekas | 411/339 |
| 5,655,342 | A | * | 8/1997 | Guillemet et al. | 52/217 |
| 5,692,350 | A | * | 12/1997 | Murphy, Jr. | 52/213 |
| 5,815,999 | A | * | 10/1998 | Williams | 52/223.13 |
| 5,910,085 | A | * | 6/1999 | Pruett | 52/291 |
| 6,390,747 | B1 | * | 5/2002 | Commins | 411/536 |
| 6,397,543 | B1 | * | 6/2002 | Hamar | 52/403.1 |
| 6,523,321 | B1 | * | 2/2003 | Leek et al. | 52/702 |
| 6,560,934 | B1 | * | 5/2003 | Workman | 52/126.1 |
| 6,895,718 | B2 | * | 5/2005 | Moffatt | 52/204.55 |
| 2002/0066246 | A1 | * | 6/2002 | Leek | 52/295 |
| 2002/0148935 | A1 | * | 10/2002 | Chambers | 248/231.9 |
| 2002/0157328 | A1 | * | 10/2002 | Holder | 52/126.1 |
| 2003/0009980 | A1 | * | 1/2003 | Shahnazarian | 52/712 |
| 2004/0244328 | A1 | * | 12/2004 | Bak et al. | 52/712 |

FOREIGN PATENT DOCUMENTS

| | | | |
|---|---|---|---|
| JP | 6-73803 | * | 3/1994 |

* cited by examiner

WOODEN MEMBER SUPPORT RETROFIT SYSTEM AND METHOD

BACKGROUND OF THE INVENTION

The invention relates generally to joist hangers and beam supports. More particularly, the invention relates to a joist hanger and beam support retrofit system.

There is a great need for stable and secure support of wooden framing members, in the form of wooden beams or joists, held within hardware designed to support such beams or joists. Typical examples of hardware designed to provide support are 'post caps' which attach the top of a post to a girder, or 'joist hangers' which attach joists for floors or decks to girders or walls. In addition to the support hardware, most wood framed structures require fasteners, in the form of nails or bolts, to connect different structural members. For example, these fasteners are inserted laterally through both the joist and joist hanger or beam and beam support. The fasteners are intended only to secure the joist and joist hanger or beam and beam support to each other and not intended to support the joist within the joist hanger or the beam within the beam support. In each case, the capacity of these fasteners or connectors is calculated by the shear strength of the nails or bolts required and the bearing capacity of the support hardware. The bearing capacity of the support hardware is determined by the area of the hardware the lumber rests upon and the compressive strength of the wood.

The basic assumption is that a bottom of the joist or beam rests upon a base plate, also referred to as the 'seat' or 'saddle bottom' of the hardware and is held in place by the fasteners. However, this is rarely seen in practical situations. Usually, a joist or beam made of wood shrinks after installation and a gap results between the plate of the hardware and the bottom of the wood member or beam the hardware is supposed to be supporting. As a result, the fasteners end up supporting the wood member. However, as discussed above, the fasteners were not designed to support the joists or beams and the bearing capacity of the hardware was not based solely on the fasteners.

This situation is common wherever one examines a wooden members or beam that has been in service for a year or two. Millions of wooden members have been installed over the decades, if not centuries, and many more are installed each day. Shrinkage cannot easily be controlled or accurately anticipated.

A conventional metal joist hanger 20 and wooden joist 22 are shown in FIGS. 1-4. When the joist 22 is initially placed within the joist hanger 20, the joist 22 rests within the joist hanger 20 and is supported on a base plate 24 of the joist hanger 20. Non-load bearing lateral fasteners 26 are used to secure the joist 22 in the joist hanger 20. With reference to FIGS. 3 and 4, the joist 22 and the joist hanger 20, are shown after a gap or space 28 is formed between the base plate 24 and the joist 22. The space 28 results from shrinkage of the wood forming the joist 22 over a period of time, thus causing relative movement of the base plate 24 and the joist 22 over time. This causes a load to be placed upon the fasteners 26 for which they were not designed.

Many different types of joist hangers have been employed to support beams. However, such systems use screw assemblies to adjust the location of the supporting plate of the joist hanger. For example, U.S. Pat. No. 4,192,623 discloses an adjustable joist hanger for supporting concrete decks. However, the screw assembly disclosed therein is intended to allow assembly and disassembly. In another example, U.S. Pat. No. 4,124,962 discloses a joist hanger for supporting beams that includes a screw assembly for changing the elevation of joists. However, the joist hanger lacks an integral saddle plate and the screw assembly disclosed therein is held in place by lateral fasteners which results in the lateral fasteners supporting both the screw assembly and the joist.

While methods such as those described above may provide means of providing support for beams, such methods can always be improved to provide better and more simplified means of providing support.

Accordingly, there is a need for relieving the stress upon lateral fasteners caused by the shrinkage of wood joists. What is also needed is method to retrofit conventional joist hangers. There is a further need for a means to provide additional support that compensates for the shrinkage of wood. There is an additional need for filling the gap caused by the shrinkage of wood that is relatively compact in size and inexpensive. The present invention satisfies these needs and provides other related advantages.

SUMMARY OF THE INVENTION

A process and system for retrofitting a wooden member support, such as joist hanger or beam support. This system is usable in any situation where wooden joists and joist hangers or beams and beam supports are employed. These situations can occur anywhere there is a need to construct a frame, structure or the like.

A wooden member support retrofit system includes a wooden member support having a support base and a wooden member supported by the wooden member support. The system also includes a shim disposed in a space formed between the base and the wooden member due to relative movement of the base and the wood member over time, so that the weight of the wooden member is borne by the base of the wooden member support.

The shim has a component for securing the shim to the wood member. This component may come in various forms such as a deformable knife tab or an aperture for a fastener. The component may also be such that the shim maintains contact between the wood member and the base as the wood member moves such as a spring or a one-way, ratchet mechanism which increases in thickness as the wood member moves. The component may be in the form of a flexible, compressible material that expands to maintain contact between the wood member and the base as the wood member moves.

The system includes a non-load bearing lateral fastener for securing the wooden member in the wooden member support.

A process of retrofitting a wooden member support system includes measuring a space formed between a base of a wooden member support and a wooden member due to relative movement of the base and the wooden member over time. The process further includes selecting a shim and placing the shim in the space formed between the base and the wooden member so that the weight of the wooden member is borne by the base of the wooden member support.

The selecting step includes the step of choosing a shim having a component for maintaining contact between the wooden member and the base as the wooden member moves. This component may be selected from a group of various components such as a deformable knife tab, an aperture for a fastener, a flexible and compressible material, a spring, and a one-way ratchet mechanism.

The process includes the step of securing the wooden member and wooden member support together with a non-load bearing lateral fastener.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

The present invention is useful in a variety of applications involving shrinkage of wooden joists or beams and other members where shrinkage may occur. The present invention relieves the stress upon lateral fasteners caused by the shrinkage of wooden members. The present invention also provides a method to retrofit conventional joist hangers and beam supports. The present invention additionally provides additional support that compensates for the shrinkage of wood and fills the gap caused by the shrinkage of wood that is relatively compact in size and inexpensive.

A process and system for retrofitting a joist hanger and beam support are illustrated and described that maintain contact between the joist and joist hanger or beam and beam support even after relative movement of the wood member over time. This system is usable in any situation where wooden joists and joist hangers or wooden beams and beam supports are employed. These situations can occur anywhere there is a need to construct a frame, structure or the like.

Figure 1:
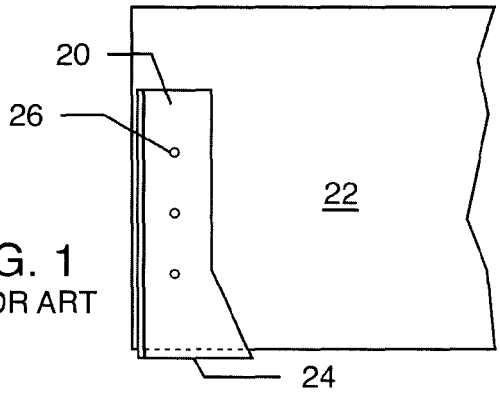
FIG. 1 PRIOR ART
FIG. 1 is a side elevation view of a joist and joist hanger.
Figure 2:
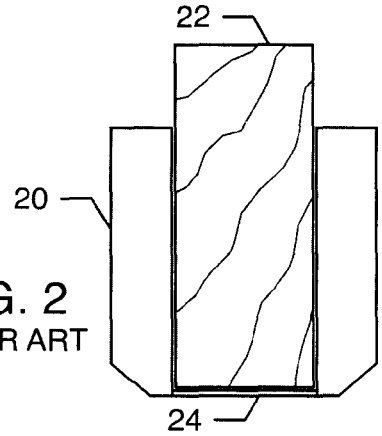
FIG. 2 PRIOR ART
FIG. 2 is a front elevation view of the joist and joist hanger of FIG. 1.
Figure 3:
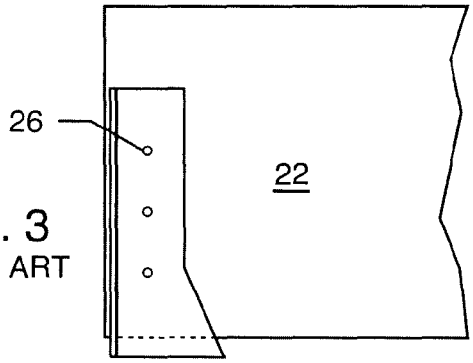
FIG. 3 PRIOR ART
FIG. 3 is a side elevation view of the joist and joist hanger of FIG. 1 after the joist has shrunk to form a gap between the joist and joist hanger.
Figure 4:
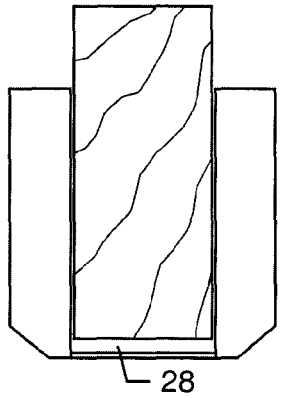
FIG. 4 PRIOR ART
FIG. 4 is a front elevation view of the joist and joist hanger of FIG. 3.
Figure 5:
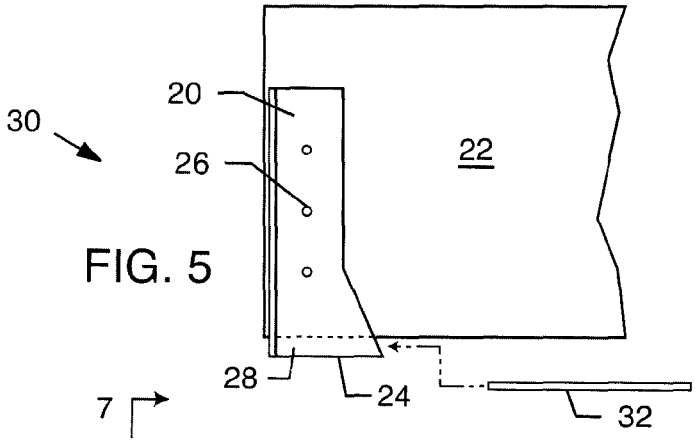
FIG. 5 is a partially exploded side elevation view of a joist, joist hanger and shim embodying the present invention.
Figure 6:
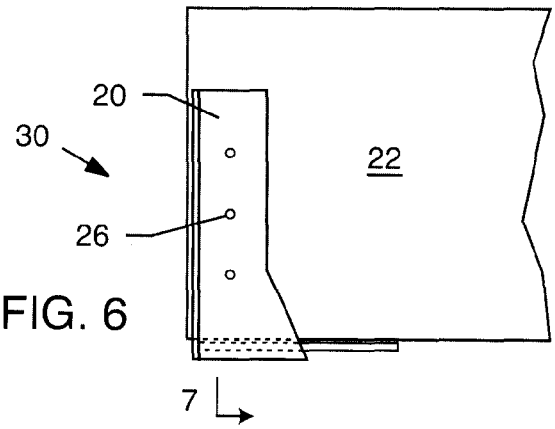
FIG. 6 is a side elevation view of a joist, joist hanger and shim embodying the present invention.
Figure 7:
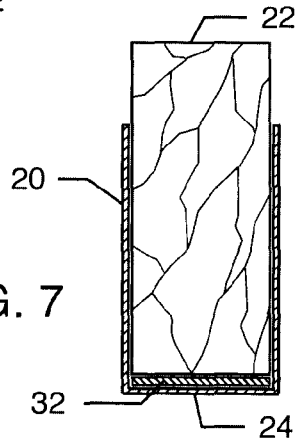
FIG. 7 is a front elevation view of FIG. 6.

As shown in the drawings for purposes of illustration, the present invention resides in a joist hanger and beam support retrofit system. With reference to FIGS. 1-13, a joist hanger support retrofit system 30 includes a joist hanger 20, a joist 22 supported by the joist hanger 20, and a shim 32. The joist hanger 20 includes the support base plate 24. The shim 32 is disposed in the space 28 formed between the base plate 24 and the joist 22. The shim 32 fills the space 28 and provides contact between the joist 22 and the joist hanger 20, allowing the weight of the joist 22 to be borne by the base plate 24 of the joist hanger 20, as seen in FIGS. 5-7 instead of by the fasteners 26.

Shims 32 are generally rectangular and planar but may be available in a multitude of shapes and sizes to fit the spaces 28 formed by the smallest joists and by the largest girders. Shims 32 may be made of a variety of materials including, without limitation, thin gage rolled steel, plastic, rubber, a flexible, compressible, expandable material or a material with a compressive strength greater the compressive strength of the wood used for the wooden joist 22. The shim 32 could even be comprised of an epoxy type hardener which is injected into the space 28. Likewise, the shim 32 could be comprised of a material such as concrete injected into the space 28.

Several shims 32 could be combined to fill larger spaces 28 but still be collectively referred to as 'a shim'. The number of individual shims 32 used can vary from joist 22 to joist 22 due to varying rates of shrinkage or the like (e.g., two or three individual shims 32 could be used to fill the space 28 below one joist 22 while four shims 32 may be used to fill the space 28 below a neighboring joist 22).

Figure 8:
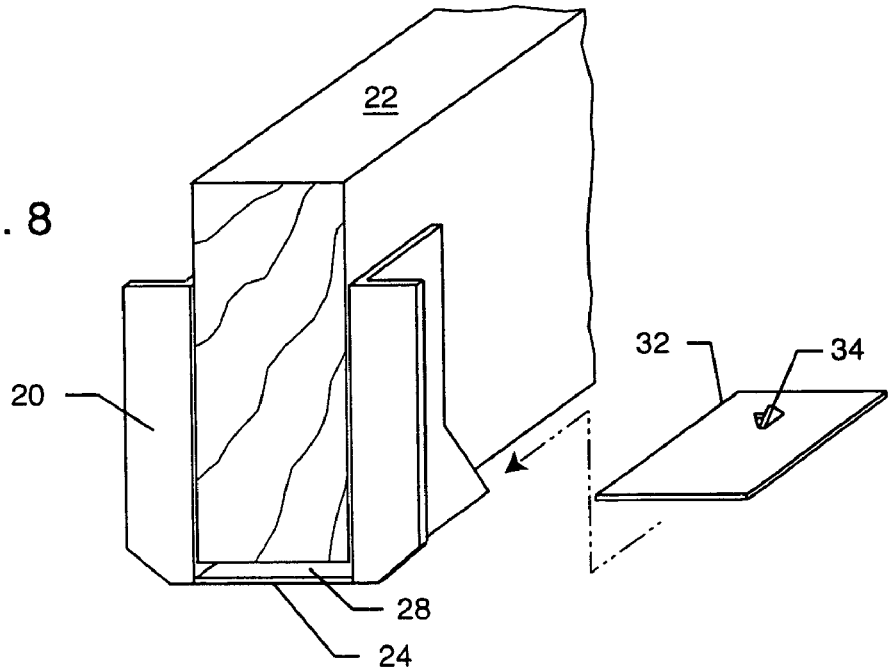
FIG. 8 is a partially exploded orthogonal view of a joist, joist hanger and shim embodying the present invention.

FIG. 8 shows a shim 32 that includes a deformable knife tab 34 for securing the shim 32 to the joist 22. The deformable knife tab 34 is driven up into the bottom of the joist 22 to keep the shim 32 in place.

Figure 9:
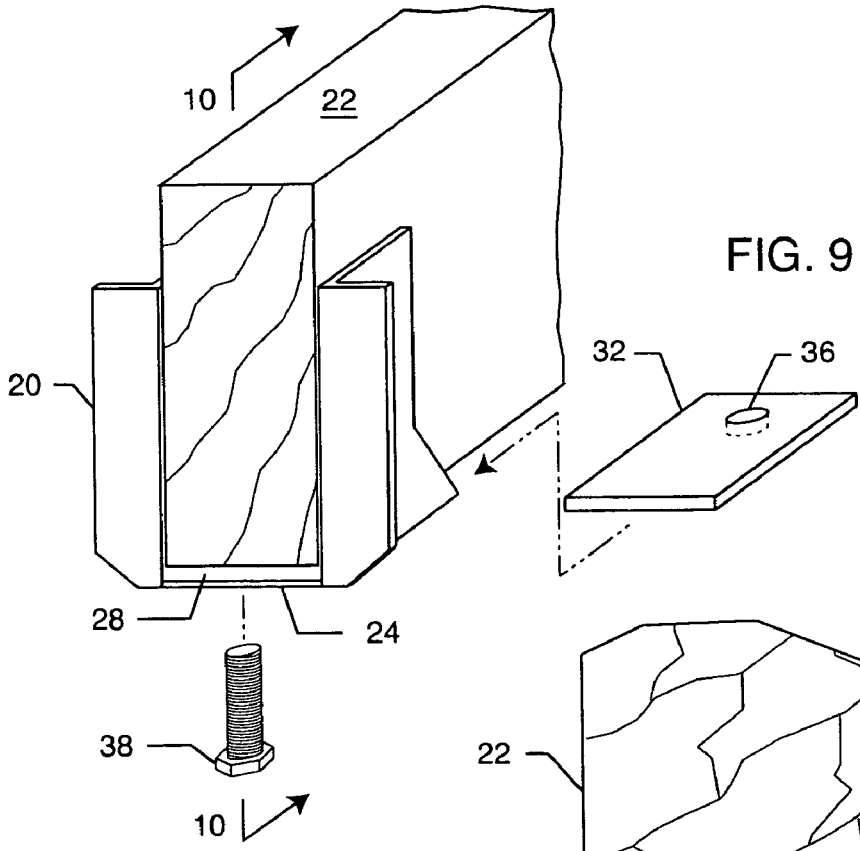
FIG. 9 is a partially exploded orthogonal view of a joist, joist hanger and shim embodying the present invention.
Figure 10:
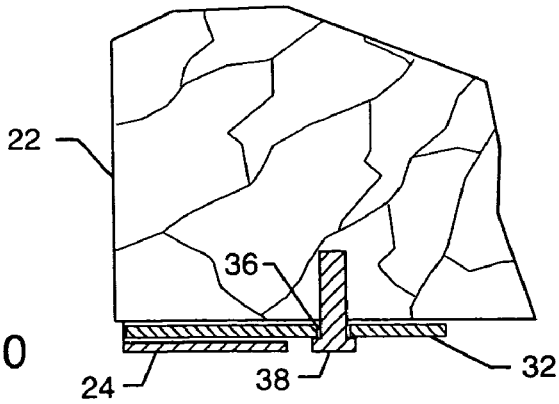
FIG. 10 is a side elevation view of FIG. 9.

FIGS. 9 and 10 illustrate a shim that includes an aperture 36 for securing the shim 32 to the joist 22 by a fastener 38. The fastener may be in the form of a bolt (threaded or non-threaded), nail, screw or the like. The shim 32 is inserted into the space 28 between the bottom of the joist 22 and the base plate 24 of the joist hanger 20 until the aperture 36 of the shim 32 is aligned with above hole 42 in the joist 22. The fastener 38 may then be inserted through the aperture 36 and into the bore hole 42 in the joist 22 that is either pre-existing or created after the shim aperture 36 is positioned. The bore hole 42 may be created by drilling, hammering a nail into the joist 22, screwing a screw into the joist 22 or the like. Alternatively, if the base plate 24 includes an aperture (not shown), then the shim 32 may be positioned so that the aperture of the base plate 24, the aperture 36 of the shim 32, and the bore hole 42 are aligned.

Figure 11:
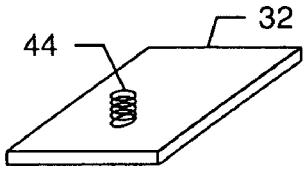
FIG. 11 is an orthogonal view of a shim embodying the present invention.
Figure 12:
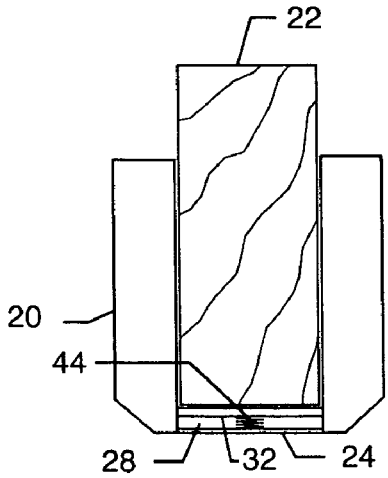
FIGS. 12 and 13 are front elevation views of the shim of FIG. 11 expanding to maintain contact between the joist and joist hanger as the joist shrinks.
Figure 13:
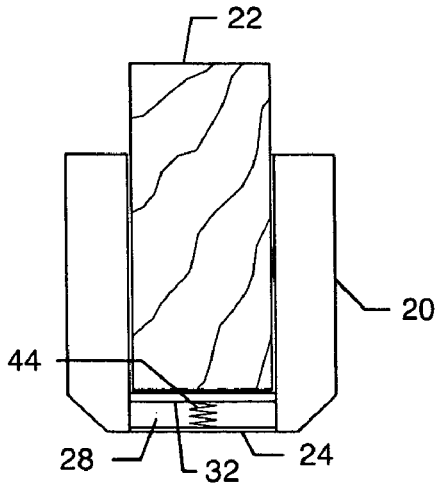

FIGS. 11-13 show a shim 32 that includes a spring 44 that expands to maintain contact between the joist 22 and the base plate 24 as the space 28 between the joist 22 and joist hangar increases. A similar application exists for beams.

Figure 14:
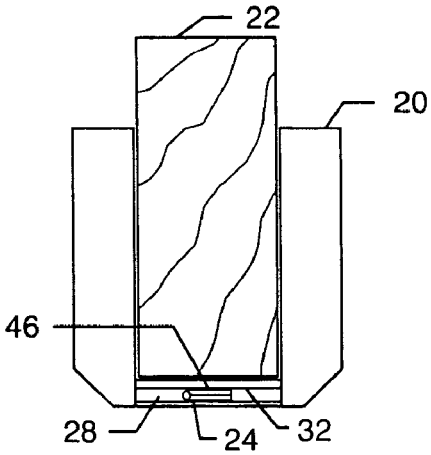
FIGS. 14 and 15 are front elevation views of a shim with a one-way, ratchet mechanism expanding to maintain contact between a joist and joist hanger as the joist shrinks.
Figure 15:
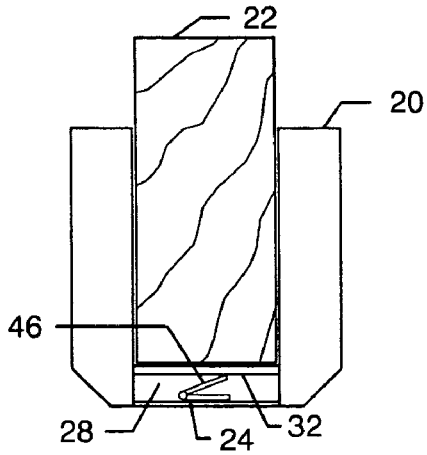

A shim 32 may also include a one-way, ratchet mechanism 46 which can be increased in thickness to match the shrinkage of the joist 22, as illustrated in FIGS. 14-15. When the shim 32 is initially inserted into the space 28, the ratchet mechanism 46 is adjusted so that the shim 32 maintains contact between the joist 22 and the base plate 24. As the space 28 between the joist 22 and joist hanger 20 increases, the ratchet mechanism 46 is again adjusted so that the shim 32 maintains contact between the joist 22 and the base plate 24.

Figure 16:
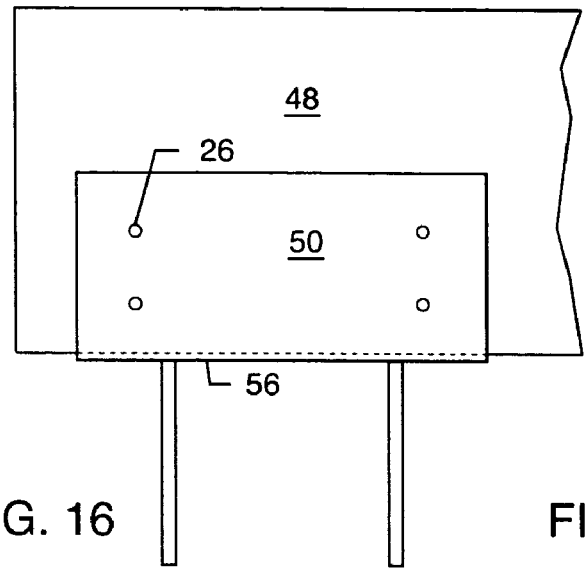
FIG. 16 is a side elevation view of a beam and beam support combination.
Figure 17:
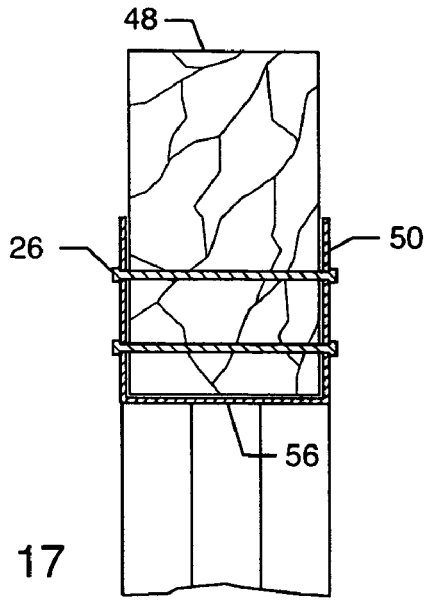
FIG. 17 is a front elevation view of the beam and beam support of FIG. 14.
Figure 18:
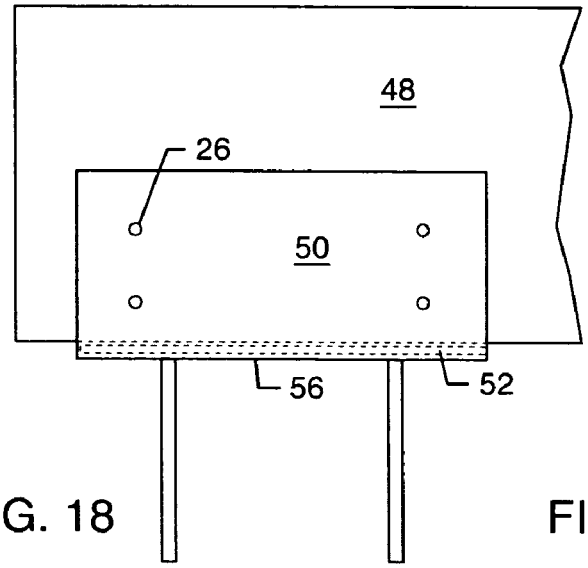
FIG. 18 is a side elevation view of the beam and beam support of FIG. 14 after the beam has shrunk to form a gap between the beam and beam support and a shim embodying the present invention filling the gap.
Figure 19:
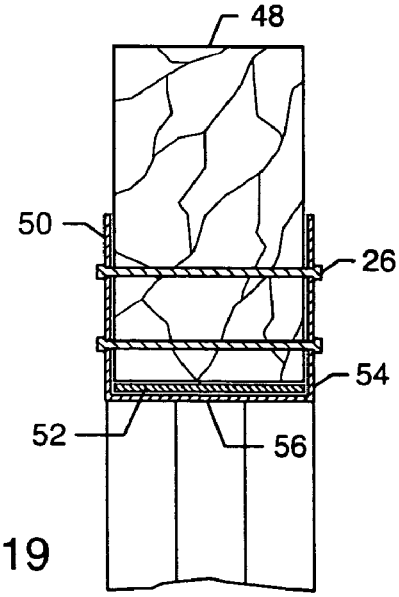
FIG. 19 is a front elevation view of the beam, beam support and shim of FIG. 16.

A conventional wooden beam 48, beam support 50 and lateral fastener 26 arrangement is shown FIGS. 16 and 17. As the wood shrinks, a shim 52 made of steel, plastic, rubber, a flexible compressible material, an epoxy hardener, concrete or a material with a compressive strength greater than the compressive strength of the wood used for the wooden beam 48 is inserted into a space 54 formed between the beam 48 and beam support 50, as seen in FIGS. 18 and 19. The shim 52 expands to maintain contact between the beam 48 and a base plate 56 of the support 50 as the space 54 between the beam 48 and the beam support 50 increases. The shim 52 used may also be similar to those illustrated with respect to shim 52 in FIGS. 5 and 8-15.

In use, the process of retrofitting a joist hanger 20 or beam support 50 begins some time after a wooden joist 22 or beam 48 is initially placed within the joist hanger 20 or beam support 50 and non-load bearing lateral fasteners 26 inserted to secure the joist 22 and joist hanger 20 or beam 48 and beam support 50 together. The joist 22 or beam 48 initially rests upon a respective base plate 24, 56, of the joist hanger 20 or beam support 50 and the base plate 24, 56 bears the weight of the joist 22 or beam 48.

Retrofitting of the joist hanger 20 or beam support 50 begins after a space 28, 54 begins to form between the base plate 24, 56 and the bottom surface of joist hanger 20, or beam support 50 after the wood of the joist 22 or beam 48 begins to shrink. A user measures the space 28, 54 formed between the base plate 24, 56 and the bottom surface of the joist 22 or beam 48.

The user then selects a shim 32, 52 to fit within the space 28, 54. A number of shims may be stacked one atop another to fill the space 28, 54. This group of stacked individual shims 32, 52 may be collectively referred to as 'a shim'; the number of individual shims used depending on the size of the space 28, 54. The shim 32, 52 is then placed in the space 28, 54 formed between the base plate 24, 56 and the joist 22 or beam 48 so that the weight of the joist 22 or beam 48 is once again borne by the base plate 24, 56 of the joist hanger 20 or beam support 50.

When the user selects a shim 32, 52 the user can select a simple shim 32, 52 or one that includes a component for maintaining contact between the joist 22 or beam 48 and the base plate 24, 56 as the joist 22 or beam 48 moves. This shim component can come in the form of a deformable knife tab 34, an aperture 36 for a fastener 38, a spring 44, and a one-way ratchet mechanism 46 or member made of a flexible compressible material. The shim 32, 52 can be selected from a variety of materials such as steel, plastic, rubber, a flexible compressible material or a material with a compressive strength greater than that of the wood being used. The shim 32, 52 could even be comprised of an epoxy type hardener which is injected into the space 28, 54. Likewise, the shim 32, 52 could be comprised of a material such as concrete injected into the space 28, 54.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A wooden member support retrofit system, comprising:

a wooden member support including a support base;

a wooden member supported by the wooden member support; and a shim disposed between vertically extending side of the wooden member support and sized to substantially prevent horizontal movement therebetween, wherein the shim maintains contact with the wooden member through vertical expansion thereof so that the weight of the wooden member is borne by the base of the wooden member support due to the shim translating the weight of the wooden member upon the shim to the support base.

2. The system of claim 1, including a non-load bearing lateral fastener for securing the wooden member in the wooden member support.

3. The system of claim 1, wherein the shim is comprised of a flexible, compressible material that expands to maintain contact between the wooden member and the base as the wooden member moves.

4. The system of claim 1, wherein the shim includes a spring that expands to maintain contact between the wooden member and the base as the wooden member moves.

5. A wooden member support retrofit system, comprising:

a wooden member support including a support base;

a wooden member supported by the wooden member support;

a non-load bearing lateral fastener for securing the wooden member in the wooden member support; and a shim disposed between vertically extending sides of the wooden member support and sized to substantially prevent horizontal movement therebetween, wherein the shim maintains contact with the wooden member through vertical expansion thereof so that the weight of the wooden member is borne by the base of the wooden member support due to the shim translating the weight of the wooden member upon the shim to the support base.

6. The system of claim 5, wherein the shim is comprised of a flexible, compressible material that expands to maintain contact between the wooden member and the base as the wooden member moves.

7. The system of claim 5, wherein the shim includes a spring that expands to maintain contact between the wooden member and the base as the wooden member moves.

8. A process of retrofitting a wooden member support system, comprising the step of:

measuring a space formed between a base of a wooden member support and a wooden member due to relative movement of the base and the wooden member over time;

selecting a shim sized to substantially prevent horizontal movement therebetween when disposed between vertically extending sides of the wooden member support; and placing the shim in the space formed between the base and the wooden member so that the weight of the wooden member is borne by the base of the wooden member support wherein the selecting step includes the step of choosing a shim having a component for maintaining contact between the wooden member and the base as the wooden member moves, from one of a flexible and compressible material and a spring.

9. The process of claim 8, including the step of securing the shim to the wooden member with a flexible, compressible material connected to the shim that expands to maintain contact between the wooden member and the base as the wooden member moves.

10. The process of claim 8, including the step of securing the shim to the wooden member with a spring connected to the shim.

11. The process of claim 8, including the step of securing the wooden member and wooden member support together with a non-load bearing lateral fastener.

12. A process of retrofitting a wooden member support system, comprising the step of:

measuring a space formed between a base of a wooden member support and a wooden member due to relative movement of the base and the wooden member over time;

selecting a shim sized to substantially prevent horizontal movement therebetween when disposed between vertically extending sides of the wooden member support;

placing the shim in the space formed between the base and the wooden member so that the weight of the wooden member is borne by the base of the wooden member; and securing the wooden member and wooden member support together with a non-load bearing lateral fastener; wherein the selecting step includes the step of choosing a shim having a component for maintaining contact between the wooden member and the base as the wooden member moves, from one of a flexible and compressible material and a spring.

* * * * *